US010364405B2

(12) United States Patent
Yumioka

(10) Patent No.: US 10,364,405 B2
(45) Date of Patent: Jul. 30, 2019

(54) TRANSPARENT SOLID DETERGENT

(71) Applicant: AJINOMOTO CO., INC., Tokyo (JP)

(72) Inventor: Rina Yumioka, Kawasaki (JP)

(73) Assignee: AJINOMOTO CO., INC., Tokyo (JP)

( * ) Notice: Subject to any disclaimer, the term of this patent is extended or adjusted under 35 U.S.C. 154(b) by 0 days.

(21) Appl. No.: 15/487,786

(22) Filed: Apr. 14, 2017

(65) Prior Publication Data

US 2017/0218305 A1 Aug. 3, 2017

Related U.S. Application Data

(63) Continuation of application No. PCT/JP2015/079196, filed on Oct. 15, 2015.

(30) Foreign Application Priority Data

Oct. 15, 2014 (JP) ..... 2014-210999

(51) Int. Cl.

| | |
|---|---|
| ***C11D 3/00*** | (2006.01) |
| ***C11D 3/20*** | (2006.01) |
| ***C11D 3/33*** | (2006.01) |
| ***C11D 1/10*** | (2006.01) |
| ***C11D 1/94*** | (2006.01) |
| ***C11D 1/37*** | (2006.01) |
| ***C11D 17/00*** | (2006.01) |

(52) U.S. Cl.

CPC ..... *C11D 3/0094* (2013.01); *C11D 1/10* (2013.01); *C11D 1/37* (2013.01); *C11D 1/94* (2013.01); *C11D 3/20* (2013.01); *C11D 3/201* (2013.01); *C11D 3/2065* (2013.01); *C11D 3/33* (2013.01); *C11D 17/0095* (2013.01)

(58) Field of Classification Search

None

See application file for complete search history.

(56) References Cited

U.S. PATENT DOCUMENTS

| | | | |
|---|---|---|---|
| 5,098,608 | A | 3/1992 | Miyazawa et al. |
| 2012/0309666 | A1 | 12/2012 | Nagura et al. |

FOREIGN PATENT DOCUMENTS

| | | | | | |
|---|---|---|---|---|---|
| JP | 55-25465 | A | | 2/1980 | |
| JP | 4-1297 | A | | 1/1992 | |
| JP | 6-264092 | A | | 9/1994 | |
| JP | 09125100 | | * | 5/1997 | |
| JP | 11-323379 | A | | 11/1999 | |
| JP | 2010-202760 | A | | 9/2010 | |
| WO | WO-2009071299 | A1 | * | 6/2009 | ..... C11D 1/10 |
| WO | WO 2011/104886 | A1 | | 9/2011 | |

OTHER PUBLICATIONS

Machine Translation of JP 2010-202760 dated Sep. 16, 2010 (Year: 2010).*

International Search Report dated Dec. 8, 2015 in PCT/JP2015/079196.

* cited by examiner

*Primary Examiner* — Tanisha Diggs

(74) *Attorney, Agent, or Firm* — Oblon, McClelland, Maier & Neustadt, L.L.P.

(57) ABSTRACT

The present invention provides a transparent solid detergent containing (A) N-acyl acidic amino acid salt, (B) acylglycine salt and (C) polyvalent alcohol, at a proportion of (A) 4.5-5000 parts by weight and (C) 2.5-2400 parts by weight, per 1 part by weight of (B), which suppresses coloration by heating during production, is superior in preservation stability at low temperature and high temperature, is low irritant, and shows good sense of use.

12 Claims, No Drawings

TRANSPARENT SOLID DETERGENT

CROSS REFERENCES TO RELATED APPLICATIONS

This application is a continuation of International Patent Application No. PCT/JP2015/079196, filed on Oct. 15, 2015, and claims priority to Japanese Patent Application No. 2014-210999, filed on Oct. 15, 2014, both of which are incorporated herein by reference in their entireties.

BACKGROUND OF THE INVENTION

Field of the Invention

The present invention relates to a transparent solid detergent superior in preservation stability and usability.

Discussion of the Background

Conventionally, as transparent solid detergent, those containing a higher fatty acid salt as a main agent and added with glycerin, sucrose, sorbitol or the like as a transparentizing agent are mainly used. Transparent solid detergent gives a sense of high quality and has high commercial value. However, a transparent solid detergent containing a higher fatty acid salt as a main agent lacks transparency and has defects such as irritation to the skin, poor foaming property in hard water and the like. Thus, transparent solid detergents using acyl acidic amino acids have been studied.

For example, a transparent solid detergent containing N-long chain acyl acidic amino acid salt as a main agent is known to be superior in transparency and mild to the skin; however, it is insufficient in terms of high temperature stability and foaming (patent document 1).

In addition, a transparent solid detergent using a salt of N-long chain acyl acidic amino acid salt in combination with ethanolamine salt and alkali metal salt has problems in that coloration occurs due to heating during production and in terms of adhesion of soft formulation to containers (patent document 2).

Furthermore, a transparent solid detergent in consideration of a molar composition ratio of potassium salt, sodium salt and ethanolamine salt of N-long chain acyl acidic amino acid salt has a problem in that it becomes soft in a high temperature and high humidity environment (patent document 3).

In addition, a transparent solid detergent wherein an N-long chain acyl acidic amino acid salt is blended with an alkyl-modified silicone as components is insufficient in terms of stability at low temperature and usability such as foaming power and easy rising off (patent document 4).

On the other hand, while a cleansing composition wherein acyl acidic amino acid and acyl neutral amino acid are blended in combination is known, it does not relate to a transparent solid detergent (patent document 5), and no case is known to date in which these two kinds of N-acyl amino acid salts were combined and studied in an attempt to solve the above-mentioned problem relating to transparent solid cleansing compositions.

DOCUMENT LIST

Patent Documents patent document 1: JP-A-55-25465
patent document 2: JP-A-4-1297
patent document 3: JP-A-6-264092 patent document 4: WO 2011/104886
patent document 5: JP-A-11-323379

SUMMARY OF THE INVENTION

Problems to be Solved by the Invention

The present invention aims to provide a transparent solid detergent having high transparency, low irritant, good sense of use, and superior in stability to heat during production and low temperature and high temperature preservation stability.

Means of Solving the Problems

The present inventors have conducted intensive studies in an attempt to solve the above-mentioned problems and found that a composition containing a particular acyl acidic amino acid salt, an acylglycine salt and polyvalent alcohol at a particular mixing ratio (preferably particular pH) can afford a transparent solid detergent having high transparency and superior usability, which is superior in manufacturability and suppresses coloration due to heating during production (stability to heating) and maintains preservation stability at low and high temperatures, and that a transparent solid detergent superior in the sense of use and manufacturability can be provided by further mixing with a particular lower alcohol at a particular ratio, which resulted in the completion of the present invention.

Therefore, the present invention provides the following.

[1] A transparent solid detergent comprising the following components (A), (B) and (C), at a proportion of (A) 4.5-5000 parts by weight and (C) 2.5-2400 parts by weight, per 1 part by weight of (B):
(A) N-acyl acidic amino acid salt
(B) acylglycine salt
(C) polyvalent alcohol.

[2] The transparent solid detergent of [1], further comprising the following component (D):
(D) lower alcohol.

[3] The transparent solid detergent of [1] or [2], wherein (A) acidic amino acid is glutamic acid or aspartic acid.

[4] The transparent solid detergent of any one of [1]-[3], wherein (A) N-acyl acidic amino acid salt is a salt with at least one selected from the group consisting of sodium, potassium and triethanolamine.

[5] The transparent solid detergent of any one of [1]-[4], wherein (B) acylglycine salt is a salt with at least one selected from the group consisting of sodium, potassium and triethanolamine.

[6] The transparent solid detergent of any one of [1]-[5], wherein (C) polyvalent alcohol is at least one kind selected from the group consisting of glycerol, sorbitol, glycosyl trehalose, trehalose and sucrose.

[7] The transparent solid detergent of any one of [2]-[6], wherein (D) lower alcohol is at least one kind selected from the group consisting of ethanol and isopropyl alcohol.

[8] The transparent solid detergent of any one of [1]-[7], having a pH of 6.1-6.9.

[9] A transparent solid detergent comprising the following components (A)-(D) at contents on charging:
(A) N-acyl acidic amino acid salt: 20-50 parts by weight
(B) acylglycine salt: 0.01-4.4 parts by weight
(C) polyvalent alcohol: 11-24 parts by weight
(D) lower alcohol: 2.5-30 parts by weight.

[10] The transparent solid detergent of [9], wherein (A) acidic amino acid is glutamic acid or aspartic acid.

[11] The transparent solid detergent of [9] or [10], wherein (A) N-acyl acidic amino acid salt is a salt with at least one selected from the group consisting of sodium, potassium and triethanolamine.

[12] The transparent solid detergent of any one of [9]-[11], wherein (B) acylglycine salt is a salt with at least one selected from the group consisting of sodium, potassium and triethanolamine.

[13] The transparent solid detergent of any one of [9]-[12], wherein (C) polyvalent alcohol is at least one kind selected from the group consisting of glycerol, sorbitol, glycosyl trehalosa, trehalose and sucrose.

[14] The transparent solid detergent of any one of [9]-[13], wherein (D) lower alcohol is at least one kind selected from the group consisting of ethanol and isopropyl alcohol.

[15] The transparent solid detergent of any one of [9]-[14], having a pH of 6.1-6.9.

[16] A transparent solid detergent comprising the following components (A)-(D) at contents on charging:

(A) N-acyl acidic amino acid salt: 20-50 wt %

(B) acylglycine salt: 0.01-4.4 wt %

(C) polyvalent alcohol: 11-24 wt %

(D) lower alcohol: 2.5-30 wt %.

Effect of the Invention

According to the present invention, a transparent solid detergent which maintains transparency without coloration due to heating during production, keeps an appearance with high commercial value even when the temperature changes to a low temperature or a high temperature, and permits free changes such as coloration and the like can be provided.

According to the present invention, a transparent solid detergent superior in foaming power such as foaming, lather amount and foam retention, and usability such as easy rinsing off and the like can be provided.

DETAILED DESCRIPTION OF THE PREFERRED EMBODIMENTS

The present invention relates to a transparent solid detergent containing (A) N-acyl acidic amino acid salt and (B) acylglycine salt, and (C) polyvalent alcohol, and further, (D) lower alcohol as necessary, at particular ratios (hereinafter sometimes to be abbreviated as the transparent solid detergent of the present invention).

The degree of transparency can be evaluated by cutting a sample in 1 cm thickness, placing same on 12 point type letters, and determining whether the type letters can be identified through the sample.

As component (A) N-acyl acidic amino acid salt in the present invention, any of D form, L form and DL form can be used. Each of these N-acyl acidic amino acid salts may be used alone, or two or more kinds thereof may be used in a mixture at any ratio.

The acyl group of component (A) N-acyl acidic amino acid salt in the present invention is an acyl group induced from fatty acid having 8-20 carbon atoms, and an acyl group induced from fatty acid having 8-18 carbon atoms is preferable, and an acyl group induced from fatty acid having 12-14 carbon atoms is more preferable.

For example, an acyl group induced from lauric acid, myristic acid, palmitic acid, stearic acid, oleic acid, isostearic acid and the like, a mixture thereof such as beef tallow fatty acid, coconut oil fatty acid, palm kernel oil fatty acid and the like can be mentioned, an acyl group induced from lauric acid, myristic acid, coconut oil fatty acid is preferable, and an acyl group induced from lauric acid, myristic acid is more preferable.

While the component (A) acidic amino acid in the present invention is not particularly limited as long as it is an acidic amino acid, examples thereof include glutamic acid, aspartic acid and the like, and glutamic acid and aspartic acid are preferable.

As a salt of N-acyl acidic amino acid, alkali metal salts such as lithium salt, sodium salt, potassium salt and the like; alkaline earth metal salts such as calcium salt, magnesium salt and the like; alkanolamine salts such as monoethanolamine salt, diethanolamine salt, triethanolamine (TEA) salt and the like; ammonium salt; and salt of basic organic substance and the like can be mentioned. Of these, alkali metal salt and alkanolamine salt are preferable, and sodium salt, potassium salt, triethanolamine are more preferable, since one superior in foaming and preservation stability is obtained.

Component (A) may be in the form of a salt by neutralizing by adding together with N-acyl acidic amino acid and a substance (e.g., sodium hydroxide, potassium hydroxide, TEA etc.) that forms the above-mentioned salt when the transparent solid detergent of the present invention is prepared. Furthermore, component (A) may contain unneutralized N-acyl acidic amino acid.

Specific examples of the N-acyl acidic amino acid salt to be used in the present invention include monosodium salt, monopotassium salt, triethanolamine salt and the like of N-lauroylglutamic acid, N-myristoylglutamic acid, N-cocoyl (coconut oil fatty acid acyl) glutamic acid, N-lauroylaspartic acid, N-myristoylaspartic acid or N-cocoylaspartic acid. Only one kind of these may be used or two or more kinds thereof may be used in a mixture. Of these, a sodium salt or a triethanolamine salt of N-lauroylglutamic acid, N-myristoylglutamic acid, N-cocoylglutamic acid, or a mixture thereof is preferable.

Component (B) acylglycine salt of the present invention may be used alone, or two or more kinds thereof may be used in a mixture at an optional ratio.

The acyl group of component (B) acylglycine salt in the present invention is an acyl group induced from a fatty acid having 8-20 carbon atoms, an acyl group induced from a fatty acid having 8-18 carbon atoms is preferable, and an acyl group induced from a fatty acid having 12-14 carbon atoms is more preferable.

For example, an acyl group induced from lauric acid, myristic acid, palmitic acid, stearic acid, oleic, acid, isostearic acid and the like, or a mixture thereof such as beef tallow fatty acid, coconut oil fatty acid, palm kernel oil fatty acid and the like can be mentioned, an acyl group induced from lauric acid, myristic acid or coconut oil fatty acid is preferable, and an acyl group induced from lauric acid, myristic acid or coconut oil fatty acid is more preferable from the aspects of foam sustainability and usability at low temperatures.

As a salt of acylglycine, alkali metal salts such as lithium salt, sodium salt, potassium salt and the like; alkaline earth metal salts such as calcium salt, magnesium salt and the like; alkanolamine salts such as monoethanolamine salt, diethanolamine salt, triethanolamine salt and the like; ammonium salt; and salt of basic organic substance and the like can be mentioned. Of these, alkali metal salt is preferable, and sodium salt and potassium salt are more preferable, since one superior in foaming, easy rinsing off and preservation stability is obtained.

Component (B) may be in the form of a salt by neutralizing by adding together with acylglycine and a substance (e.g., sodium hydroxide, potassium hydroxide, TEA etc.) that forms the above-mentioned salt when the transparent solid detergent of the present invention is prepared. Furthermore, component (B) may contain unneutralized acylglycine.

Specifically, N-cocoyl (coconut oil fatty acid acyl) glycine potassium, N-cocoylglycine sodium and the like can be mentioned, and N-cocoylglycine potassium and N-cocoylglycine sodium are preferable.

As component (C) polyvalent alcohol in the present invention, glycerols such as glycerol, diglycerol, polyglycerol and the like, sugar alcohols such as sorbitol, glycosyl trehalose, trehalose, sucrose, erythritol, xylitol and the like, glycols such as isopreneglycol, dipropyleneglycol, ethoxydiglycol, 1,3-butyleneglycol and the like can be mentioned. These may be used alone or two or more kinds thereof may be used in a mixture. Of these, glycerols and sugar alcohol are preferable, glycerol and sorbitol are more preferable to obtain a transparent solid detergent having superior usability and high transparency, which suppresses coloration due to heating during production (stability to heating) and maintains preservation stability at low and high temperatures.

Component (D) lower alcohol in the present invention is a straight chain or branched alcohol having 1-4 carbon atoms, and ethanol, n-propyl alcohol, isopropyl alcohol, n-butyl alcohol, propanol and the like can be mentioned. From the aspects of manufacturability and suppression of coloration by heating at a high temperature during production, ethanol, n-propyl alcohol or isopropyl alcohol is preferable, and ethanol or isopropyl alcohol is more preferable.

The transparent solid detergent of the present invention characteristically contains 4.5-5000 parts by weight of (A) per 1 part by weight of (B). It is preferably 6.7-150 parts by weight, more preferably 11.7-140 parts by weight of (A), per 1 part by weight of (B). Within this range, a transparent solid detergent that maintains transparency, suppresses coloration developed by heating at a high temperature during production, and is superior in foaming, easy rinsing off and the like can be provided.

The transparent solid detergent of the present invention generally contains 2.5-2400 parts by weight, preferably 3.7-80 parts by weight, more preferably 5-40 parts by weight, of (C), per 1 part by weight of (B). Within this range, a transparent solid detergent superior in preservation stability and the like can be provided.

The transparent solid detergent of the present invention may further contain component (D). While the content is not particularly limited, it is generally not more than 5 parts by weight, preferably not more than 3 parts by weight, relative to the whole transparent solid detergent (100 parts by weight).

The pH of the transparent solid detergent of the present invention is generally more than 6 and less than 7, preferably 6.1-6.9, more preferably 6.3-6.7. Within the range, a transparent solid detergent that maintains transparency, suppresses coloration developed by heating at a high temperature during production, and is superior in foaming, and easy rinsing off can be provided.

The pH of the transparent solid detergent of the present invention is defined to be pH of a 1% aqueous solution (40° C.).

The transparent solid detergent of the present invention is characteristically produced by blending components (A)-(D) at the below-mentioned doses when charged. After charging, the mixture is heated to uniformly dissolve each component, injected into a mold, cooled for solidification, dried and matured to give a transparent solid detergent.

The content of component (A) on charging is generally not less than 20 parts by weight, preferably not less than 30 parts by weight, more preferably not less than 35 parts by weight, particularly preferably not less than 37 parts by weight, and generally not more than 50 parts by weight, preferably not more than 45 parts by weight, more preferably not more than 44 parts by weight.

When (A) is less than 20 parts by weight, since preservation at a low temperature or a high temperature causes precipitation and softening, the dosage foam as a transparent solid detergent cannot be maintained and the foamability is also insufficient. When it exceeds 50 parts by weight, gelling during production may occur to enable the production.

The content of component (B) on charging is generally not less than 0.01 part by weight, preferably not less than 0.1 part by weight, more preferably not less than 0.2 parts by weight, particularly preferably not less than 0.3 parts by weight, and generally less than 4.5 parts by weight, preferably not more than 4.4 parts by weight, more preferably not more than 4 parts by weight, particularly preferably not more than 3 parts by weight.

When (B) is less than 0.01 part by weight, a sufficient effect on the foamability may not be exhibited, and when it is not less than 4.5 parts by weight, coloration during production and stability in high temperature preservation may be degraded.

The content of component (C) on charging generally exceeds 10 parts by weight, is preferably not less than 11 part by weight, more preferably not less than 12 parts by weight, particularly preferably not less than weight 15 parts by, and generally less than 25 parts by weight, preferably not more than 24 parts by weight, more preferably not more than 22 parts by weight, particularly preferably not more than 20 parts by weight.

When (C) is not more than 10 parts by weight, stability in low temperature and high temperature preservation may be degraded, and when it is not less than 25 parts by weight, stability in high temperature preservation may be degraded and foamability may become poor.

The content of component (D) on charging generally exceeds 2 parts by weight, is preferably not less than 2.5 parts by weight, more preferably not less than 3 parts by weight, and generally less than 40 parts by weight, preferably not more than 30 parts by weight, more preferably not more than 25 parts by weight, particularly preferably not more than 20 parts by weight.

When (D) is not more than 2 parts by weight, production is not possible due to gelling during production, and when it is not less than 40 parts by weight, drying sometimes takes time.

The pH on charging generally exceeds pH 6 and is less than 7, preferably not less than 6.1, more preferably not less than 6.2, particularly preferably not less than 6.3, and preferably not more than 6.9, more preferably not more than 6.8, particularly preferably not more than 6.7.

For example, when the pH is not more than 6, stability at low temperature is degraded, and when it is not less than 7, stability at a high temperature is degraded. Thus, when charged at a pH in the above-mentioned range, a transparent solid detergent with good stability can be produced.

The transparent solid detergent of the present invention can be produced by a method known per se. For example, a mixture of the above-mentioned respective components and other additives are mixed, and the mixture is generally heated at 70-90° C., preferably 70-80° C., for 20 min-1 hr, preferably 20 min-30 min, to uniformly dissolved each component. The composition in a molten state is injected into a mold having a product shape, and cooled and solidified over 15 min-30 min, and dried and matured to obtain a transparent solid detergent.

Various generally-used additives can be added to the transparent solid detergent of the present invention as long as the effect of the invention is not inhibited.

For example, starting materials and the like described in various official compendia such as Japanese Standards of Cosmetic Ingredients, Cosmetic Ingredients Codex, Japanese Standard of Quasi-drug Ingredients, the Japanese Pharmacopoeia, Japanese Standards for Pharmaceutical Ingredient, Japan's Specifications and Standards for Food Additives and the like, such as higher alcohols such as cetyl alcohol, stearyl alcohol, behenyl alcohol, isostearyl alcohol, octyldodecanol, oleyl alcohol, myristyl alcohol and the like; higher fatty acids such as lauric acid, myristic acid, palmitic acid, stearic acid, hardened beef tallow fatty acid, coconut oil fatty acid, palm oil fatty acid and the like and a salt thereof; moisturizers such as trimethylglycine and the like; surfactants such as anionic surfactant, cationic surfactant, amphoteric surfactant, non-ionic surfactant and the like; synthetic fats and oils such as vegetable oil, animal fats and oils, natural fat and oil derivatives, mineral fats and oils, lower and higher fatty acid ester, N-acylglutamic acid ester and the like; silicone compound; polymer substance; animal and plant extracts; amino acid; nucleic acid; vitamin; enzyme; anti-inflammatory agent; antimicrobial agent; preservative; antioxidant; ultraviolet absorber; chelating agent; adiaphoretic; oxidation dye; pH adjuster; pearly sheen agent; and the like can be mentioned.

Other features of the invention will become apparent in the course of the following descriptions of exemplary embodiments which are given for illustration of the invention and are not intended to be limiting thereof.

EXAMPLES

While the present invention is explained in more detail in the following by referring to Examples, the present invention is not limited by these Examples.

[Preparation of Solid Cleansing Composition]

Respective components in the amounts (parts by weight) shown in Tables 1-8 are mixed, the mixture is heated at 70-80° C. to uniformly dissolve each component. The mixture is injected into a mold. Thereafter, the mixture was cooled and solidified, and dried and matured to obtain a transparent solid detergent. Drying and maturation was performed for about 20 days to 2 months, though subject to variation depending on the amounts of polyvalent alcohol and lower alcohol. The pH was adjusted by appropriately adding sodium hydroxide.

Each solid detergent obtained according to the above was evaluated for various properties according to the following criteria. The results are shown in Tables 1-8.

[Manufacturability]

Manufacturability was evaluated according to the following criteria:

x; thickening during production

Δ; drying time required for not less than one month

○; production is possible.

Thickened detergent was excluded from the evaluation (indicated by "-" in Table).

[Stability]

Heating stability during production at 70-80° C. was evaluated according to the following criteria:

○; no coloration during heating x; coloration after heating.

[Low Temperature Preservation Stability]

Low temperature preservation stability at 0° C. was evaluated according to the following criteria:

⊙; transparent, hard and extremely fine for not less than 3 months

○; transparent, hard and fine for 1-3 months

Δ; small precipitation after lapse of 3 months x; precipitation in 3 months.

[High Temperature Preservation Stability]

High temperature preservation stability at 45° C. was evaluated according to the following criteria:

⊙; transparent, hard and extremely fine for not less than 3 months

○; transparent, hard and fine for 1-3 months

Δ; small softening after lapse of 3 months x; softening in 3 months.

[Sense of Use]

For each solid detergent, hands were washed with tap water at 40° C., and foaming, lather amount, foam retention, easy rinsing off were evaluated according to the following criteria. Evaluation was made according to the following criteria by 5 panelists, and an average of 5 panelists was marked with ⊙ for not more than 4.0—not less than 3.5; ○ for less than 3.5—not less than 2.5; Δ for less than 2.5—not less than 1.5; and x for less than 1.5.

<Foaming, Lather Amount, Foam Retention>

4; very good

3; good

2; rather low

1; low

<Easy Rinse Off>

4; very fast

3; fast

2; rather late

1; late

TABLE 1 study of component (A)

| | | Comp. Ex. 1 | Ex. 1 | Ex. 2 | Ex. 3 | Comp. Ex. 2 |
|---|---|---|---|---|---|---|
| A | lauroylglutamic acid | — | 10.7 | 10.7 | 10.7 | 20.0 |
| | myristoylglutamic acid | — | 3.2 | 3.2 | 3.2 | — |
| | cocoylglutamic acid | 11.8 | 10.9 | 13.0 | 15.6 | 14.5 |
| | NaOH | — | 1.1 | 1.1 | 1.1 | 1.1 |
| | TEA | 8.1 | 11.8 | 12.4 | 12.7 | 15.5 |
| B | cocoylglycine K | 0.9 | 0.9 | 0.9 | 0.9 | 0.9 |
| C | glycerol | 10.0 | 10.0 | 10.0 | 10.0 | 10.0 |
| | sorbitol | 5.0 | 5.0 | 5.0 | 5.0 | 5.0 |
| D | ethanol | 5.0 | 5.0 | 5.0 | 5.0 | 5.0 |
| E | pH | 6.3 | 6.3 | 6.3 | 6.3 | 6.3 |
| | NaOH | q.s. | q.s. | q.s. | q.s. | q.s. |
| | water | 59.2 | 41.4 | 38.7 | 35.8 | 28.0 |
| | manufacturability | ○ | ○ | ○ | ○ | X |
| | heating stability (coloration) during production | ○ | ○ | ○ | ○ | ○ |
| | low temperature preservation stability (precipitation) | X | ⊙ | ⊙ | ⊙ | — |
| | high temperature preservation stability (softening) | X | ○ | ○ | ○ | — |
| | foaming | Δ | ○ | ○ | ○ | — |
| | lather amount | X | ○ | ○ | ○ | — |
| | foam retention | Δ | ⊙ | ⊙ | ⊙ | — |
| | easy rinse off | ○ | ○ | ○ | ○ | — |

TABLE 2 study of component (C)

| | | Comp. Ex. 3 | Ex. 4 | Ex. 5 | Ex. 6 | Comp. Ex. 4 |
|---|---|---|---|---|---|---|
| A | lauroylglutamic acid | 10.7 | 10.7 | 10.7 | 10.7 | 10.7 |
| | myristoylglutamic acid | 3.2 | 3.2 | 3.2 | 3.2 | 3.2 |
| | cocoylglutamic acid | 13.0 | 13.0 | 13.0 | 13.0 | 13.0 |
| | NaOH | 1.1 | 1.1 | 1.1 | 1.1 | 1.1 |
| | TEA | 12.4 | 12.4 | 12.4 | 12.4 | 12.4 |
| B | cocoylglycine K | 0.9 | 0.9 | 0.9 | 0.9 | 0.9 |
| C | glycerol | 10.0 | 15.0 | 10.0 | 15.0 | 20.0 |
| | sorbitol | — | — | 5.0 | 5.0 | 5.0 |
| D | ethanol | 5.0 | 5.0 | 5.0 | 5.0 | 5.0 |
| E | pH | 6.3 | 6.3 | 6.3 | 6.3 | 6.3 |
| | NaOH | q.s. | q.s. | q.s. | q.s. | q.s. |
| | water | 43.7 | 38.7 | 38.7 | 33.7 | 28.7 |
| | manufacturability | ○ | ○ | ○ | ○ | ○ |
| | heating stability (coloration) during production | ○ | ○ | ○ | ○ | ○ |
| | low temperature preservation stability (precipitation) | Δ | ⊙ | ⊙ | ⊙ | ⊙ |
| | high temperature preservation stability (softening) | Δ | ○ | ○ | ○ | Δ |
| | foaming | ⊙ | ○ | ○ | ○ | Δ |
| | lather amount | ○ | ○ | ○ | ○ | ○ |
| | foam retention | ⊙ | ⊙ | ⊙ | ⊙ | ⊙ |
| | easy rinse off | ○ | ○ | ○ | ○ | ○ |

TABLE 3 study of component (D)

| | | Comp. Ex. 5 | Ex. 7 | Ex. 8 | Ex. 9 | Comp. Ex. 6 |
|---|---|---|---|---|---|---|
| A | lauroylglutamic acid | 10.7 | 10.7 | 10.7 | 10.7 | 10.7 |
| | myristoylglutamic acid | 3.2 | 3.2 | 3.2 | 3.2 | 3.2 |
| | cocoylglutamic acid | 13.0 | 13.0 | 13.0 | 13.0 | 13.0 |
| | NaOH | 1.1 | 1.1 | 1.1 | 1.1 | 1.1 |
| | TEA | 12.4 | 12.4 | 12.4 | 12.4 | 12.4 |
| B | cocoylglycine K | 0.9 | 0.9 | 0.9 | 0.9 | 0.9 |
| C | glycerol | 10.0 | 15.0 | 15.0 | 15.0 | 15.0 |
| | sorbitol | — | — | — | — | — |
| D | ethanol | 2.0 | 3.0 | 5.0 | 20.0 | 40.0 |
| E | pH | 6.3 | 6.3 | 6.3 | 6.3 | 6.3 |
| | NaOH | q.s. | q.s. | q.s. | q.s. | q.s. |
| | water | 46.7 | 40.7 | 38.7 | 23.7 | 3.7 |
| | manufacturability | X | ○ | ○ | ○ | Δ |
| | heating stability (coloration) during production | ○ | ○ | ○ | ○ | ○ |
| | low temperature preservation stability (precipitation) | — | ⊙ | ⊙ | ⊙ | ⊙ |
| | high temperature preservation stability (softening) | — | ○ | ○ | ○ | ○ |
| | foaming | — | ○ | ○ | ○ | X |
| | lather amount | — | ○ | ○ | ○ | X |
| | foam retention | — | ⊙ | ⊙ | ○ | X |
| | easy rinse off | — | ○ | ○ | ○ | ○ |

TABLE 4 study of component (B)

| | | Comp. Ex. 7 | Ex. 10 | Ex. 11 | Ex. 12 | Ex. 13 | Comp. Ex. 8 | Ex. 14 | Ex. 15 | Ex. 16 | Comp. Ex. 9 | Comp. Ex. 10 | Comp. Ex. 11 |
|---|---|---|---|---|---|---|---|---|---|---|---|---|---|
| A | lauroylglutamic acid | 10.7 | 10.7 | 10.7 | 10.7 | 10.7 | 10.7 | 10.7 | 10.7 | 10.7 | 10.7 | 10.7 | 10.7 |
| | myristoylglutamic acid | 3.2 | 3.2 | 3.2 | 3.2 | 3.2 | 3.2 | 3.2 | 3.2 | 3.2 | 3.2 | 3.2 | 3.2 |
| | cocoylglutamic acid | 13.0 | 13.0 | 13.0 | 13.0 | 13.0 | 13.0 | 13.0 | 13.0 | 13.0 | 13.0 | 13.0 | 13.0 |
| | NaOH | 1.1 | 1.1 | 1.1 | 1.1 | 1.1 | 1.1 | 1.1 | 1.1 | 1.1 | 1.1 | 1.1 | 1.1 |
| | TEA | 12.4 | 12.4 | 12.4 | 12.4 | 12.4 | 12.4 | 12.4 | 12.4 | 12.4 | 12.4 | 12.4 | 12.4 |
| B | cocoylglycine K | | 0.3 | 0.9 | 1.5 | 3 | 4.5 | | | | | | |
| | cocoylglycine Na | | | | | | | 0.9 | 1.5 | 3 | | | |
| | Cocoylalanine TEA | | | | | | | | | | 1.5 | | |
| | lauroylsarcosine Na | | | | | | | | | | | 1.5 | |
| | lauroylmethylalanine Na | | | | | | | | | | | | 1.5 |
| C | glycerol | 10.0 | 10.0 | 10.0 | 10.0 | 10.0 | 10.0 | 10.0 | 10.0 | 10.0 | 10.0 | 10.0 | 10.0 |
| | sorbitol | 5.0 | 5.0 | 5.0 | 5.0 | 5.0 | 5.0 | 5.0 | 5.0 | 5.0 | 5.0 | 5.0 | 5.0 |
| D | ethanol | 5.0 | 5.0 | 5.0 | 5.0 | 5.0 | 5.0 | 5.0 | 5.0 | 5.0 | 5.0 | 5.0 | 5.0 |
| E | pH | 6.3 | 6.3 | 6.3 | 6.3 | 6.3 | 6.3 | 6.3 | 6.3 | 6.3 | 6.3 | 6.3 | 6.3 |
| | NaOH | q.s. | q.s. | q.s. | q.s. | q.s. | q.s. | q.s. | q.s. | q.s. | q.s. | q.s. | q.s. |
| | water | 39.6 | 59.3 | 58.7 | 58.1 | 56.6 | 55.1 | 58.7 | 58.1 | 56.6 | 58.1 | 58.1 | 58.1 |
| | manufacturability | ○ | ○ | ○ | ○ | ○ | ○ | ○ | ○ | ○ | ○ | ○ | ○ |
| | heating stability (coloration) during production | ○ | ○ | ○ | ○ | ○ | X | ○ | ○ | ○ | ○ | ○ | ○ |
| | low temperature preservation stability (precipitation) | ⊙ | ⊙ | ⊙ | ⊙ | ⊙ | ⊙ | ⊙ | ⊙ | ⊙ | ⊙ | ⊙ | ⊙ |
| | high temperature preservation stability (softening) | ⊙ | ⊙ | ○ | ○ | ○ | X | ○ | ○ | ○ | ○ | ○ | ○ |
| | foaming | X | ○ | ○ | ⊙ | ⊙ | ⊙ | ○ | ⊙ | ⊙ | Δ | Δ | ○ |
| | lather amount | Δ | ○ | ○ | ⊙ | ⊙ | ⊙ | ○ | ⊙ | ⊙ | ○ | ○ | Δ |
| | foam retention | Δ | ○ | ⊙ | ⊙ | ⊙ | ⊙ | ⊙ | ⊙ | ⊙ | Δ | Δ | Δ |
| | easy rinse off | X | ○ | ○ | ⊙ | ⊙ | ⊙ | ○ | ⊙ | ⊙ | Δ | Δ | Δ |

TABLE 5 study of pH

| | | Comp. Ex. 12 | Comp. Ex. 13 | Ex. 17 | Ex. 18 | Ex. 19 | Comp. Ex. 14 |
|---|---|---|---|---|---|---|---|
| A | lauroylglutamic acid | 10.7 | 10.7 | 10.7 | 10.7 | 10.7 | 10.7 |
| | myristoylglutamic acid | 3.2 | 3.2 | 3.2 | 3.2 | 3.2 | 3.2 |
| | cocoylglutamic acid | 13.0 | 13.0 | 13.0 | 13.0 | 13.0 | 13.0 |
| | NaOH | 1.1 | 1.1 | 1.1 | 1.1 | 1.1 | 1.1 |
| | TEA | 12.4 | 12.4 | 12.4 | 12.4 | 12.4 | 12.4 |
| B | cocoylglycine K | 0.9 | 0.9 | 0.9 | 0.9 | 0.9 | 0.9 |
| C | glycerol | 10.0 | 10.0 | 10.0 | 10.0 | 10.0 | 10.0 |
| | sorbitol | 5.0 | 5.0 | 5.0 | 5.0 | 5.0 | 5.0 |
| D | ethanol | 5.0 | 5.0 | 5.0 | 5.0 | 5.0 | 5.0 |
| E | pH | 5.7 | 6 | 6.3 | 6.5 | 6.7 | 7 |
| | NaOH | q.s. | q.s. | q.s. | q.s. | q.s. | q.s. |
| | water | 58.7 | 58.7 | 58.7 | 58.7 | 58.7 | 58.7 |
| | manufacturability | ○ | ○ | ○ | ○ | ○ | ○ |
| | heating stability (coloration) during production | ○ | ○ | ○ | ○ | ○ | ○ |
| | low temperature preservation stability (precipitation) | X | Δ | ⊙ | ⊙ | ⊙ | ⊙ |
| | high temperature preservation stability (softening) | ⊙ | ⊙ | ○ | ○ | ○ | Δ |
| | foaming | Δ | Δ | ○ | ○ | ○ | Δ |
| | lather amount | Δ | ○ | ○ | ○ | ○ | ○ |
| | foam retention | ○ | ⊙ | ⊙ | ⊙ | ⊙ | ⊙ |
| | easy rinse off | ○ | ○ | ○ | ○ | ○ | ○ |

TABLE 6

| | | Comp. Ex. 15 | Comp. Ex. 16 |
|---|---|---|---|
| A | cocoylglutamic acid | 25.0 | 30.5 |
| | NaOH | 1.0 | 1.0 |
| | TEA | 14.0 | 18.5 |
| C | glycerol | 15.0 | 10.0 |
| | sorbitol | — | 3.0 |
| D | ethanol | 10.0 | 15.0 |
| | polydimethyl diallylammonium chloride | — | 6.0 |
| | coco amido propyl betaine | — | 8.0 |
| | water | 35.0 | 8.0 |
| | manufacturability | ○ | ○ |
| | heating stability (coloration) during production | x | x |
| | low temperature preservation stability (precipitation) | ○ | ○ |
| | high temperature preservation stability (softening) | ○ | ○ |
| | foaming | x | Δ |
| | lather amount | Δ | Δ |
| | foam retention | Δ | ○ |
| | easy rinse off | x | x |

TABLE 7

| | | Comp. Ex. 17 |
|---|---|---|
| A | cocoylglutamic acid | 30.5 |
| | NaOH | 1.0 |
| | TEA | 18.5 |
| C | glycerol | 15.0 |
| D | ethanol | 0 |
| | urea | 1.0 |
| | water | 34.0 |
| | manufacturability | x |
| | heating stability (coloration) during production | — |
| | low temperature preservation stability (precipitation) | — |

TABLE 7-continued

| | Comp. Ex. 17 |
|---|---|
| high temperature preservation stability (softening) | — |
| foaming | — |
| lather amount | — |
| foam retention | — |
| easy rinse off | — |

TABLE 8

| | | Comp. Ex. 18 |
|---|---|---|
| A | cocoylglutamic acid | 19.4 |
| | stearoylglutamic acid | 8.3 |
| | myristoylglutamic acid Na | — |
| | KOH | 0.8 |
| | TEA | 21.9 |
| C | glycerol | 16.5 |
| D | ethanol | 9.6 |
| | hydroxyethanediphosphonic acid - 4Na | 0.1 |
| | hydroxyalkylethercarboxylic acid Na | 10.6 |
| | cationic cellulose | 0.3 |
| | urea | 2.0 |
| | caprylyl methicone | 0.5 |
| | water | 10.0 |
| | manufacturability | ○ |
| | heating stability (coloration) during production | ○ |
| | low temperature preservation stability (precipitation) | Δ |
| | high temperature preservation stability (softening) | ○ |
| | foaming | Δ |
| | lather amount | Δ |
| | foam retention | Δ |
| | easy rinse off | x |

It was confirmed that the solid detergents of Examples 1-19 suppress coloration by heating during production, are superior in transparency, are stable even when preserved at low temperature or high temperature, and have a good sense of use required for detergents.

Where a numerical limit or range is stated herein, the endpoints are included. Also, all values and subranges within a numerical limit or range are specifically included as if explicitly written out.

As used herein the words "a" and "an" and the like carry the meaning of "one or more."

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

The invention claimed is:

1. A transparent solid detergent, comprising:

(A) at least one N-acyl glutamic acid salt, wherein said at least one N-acyl glutamic acid salt comprises N-lauroylglutamic acid salt, myristoylglutamic acid salt, and cocoylglutamic acid salt;

(B) at least one acylglycine salt, wherein said at least one acylglycine salt comprises cocoylglycine salt;

(C) at least one polyvalent alcohol, wherein said at least one polyvalent alcohol comprises glycerol; and (D) at least one lower alcohol, wherein said (A) at least one N-acyl glutamic acid salt is present in an amount of 35 to 45 parts by weight per 1 part by weight of said (B) at least one acylglycine salt;

said (C) at least one polyvalent alcohol is present in an amount of 11 to 24 parts by weight, per 1 part by weight of said (B) at least one acylglycine salt, and said (D) at least one lower alcohol is present in an amount of 2.5 to 30 parts by weight per 1 part of said (B) at least one acylglycine salt.

2. The transparent solid detergent according to claim 1, wherein said (A) at least one N-acyl glutamic acid salt is a salt with at least one member selected from the group consisting of sodium, potassium, and triethanolamine.

3. The transparent solid detergent according to claim 1, wherein said (B) at least one acylglycine salt is a salt with at least one member selected from the group consisting of sodium, potassium, and triethanolamine.

4. The transparent solid detergent according to claim 1, wherein said (D) at least one lower alcohol is at least one member selected from the group consisting of ethanol and isopropyl alcohol.

5. The transparent solid detergent according to claim 1, which when formed into a 1% aqueous solution at 40° C. exhibits a pH of 6.1 to 6.9.

6. A transparent solid detergent comprising:

(A) 35 to 45 parts by weight, based on the total weight of said detergent on charging, of at least one N-acyl glutamic acid salt, wherein said at least one N-acyl glutamic acid salt comprises N-lauroylglutamic acid salt, myristoylglutamic acid salt, and cocoylglutamic acid salt;

(B) 0.01 to 4.4 parts by weight, based on the total weight of said detergent on charging, of at least one acylglycine salt, wherein said at least one acylglycine salt comprises cocoylglycine salt;

(C) 11 to 24 parts by weight, based on the total weight of said detergent on charging, of at least one polyvalent alcohol, wherein said at least one polyvalent alcohol comprises glycerol; and (D) 2.5 to 30 parts by weight, based on the total weight of said detergent on charging, of at least one lower alcohol.

7. The transparent solid detergent according to claim 6, wherein said (A) at least one N-acyl glutamic acid salt is a salt with at least one member selected from the group consisting of sodium, potassium, and triethanolamine.

8. The transparent solid detergent according to claim 6, wherein said (B) at least one acylglycine salt is a salt with at least one member selected from the group consisting of sodium, potassium, and triethanolamine.

9. The transparent solid detergent according to claim 6, wherein said (D) at least one lower alcohol is at least one member selected from the group consisting of ethanol and isopropyl alcohol.

10. The transparent solid detergent according to claim 6, which when formed into a 1% aqueous solution at 40° C. exhibits a pH of 6.1 to 6.9.

11. A method of cleaning an article, comprising:

(1) contacting an article with a detergent according to claims 1; and (2) rinsing said detergent off said article.

12. A method of cleaning an article, comprising:

(1) contacting an article with a detergent according to claims 6; and (2) rinsing said detergent off said article.

* * * * *